US009415964B2

(12) United States Patent
Doi

(10) Patent No.: US 9,415,964 B2
(45) Date of Patent: Aug. 16, 2016

(54) POST-PROCESSING DEVICE

(71) Applicant: FUJI XEROX CO., LTD., Tokyo (JP)

(72) Inventor: Raita Doi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 71 days.

(21) Appl. No.: 14/468,944

(22) Filed: Aug. 26, 2014

(65) Prior Publication Data

US 2015/0266687 A1 Sep. 24, 2015

(30) Foreign Application Priority Data

Mar. 24, 2014 (JP) ..... 2014-059391

(51) Int. Cl.

| | |
|---|---|
| ***B65H 29/12*** | (2006.01) |
| ***B65H 29/60*** | (2006.01) |
| ***G03G 15/00*** | (2006.01) |
| ***B65H 29/14*** | (2006.01) |
| ***B65H 29/52*** | (2006.01) |

(52) U.S. Cl.

CPC ..... *B65H 29/125* (2013.01); *B65H 29/14* (2013.01); *B65H 29/52* (2013.01); *B65H 29/60* (2013.01); *G03G 15/6529* (2013.01); *G03G 15/6582* (2013.01); *B65H 2301/4212* (2013.01); *B65H 2301/4213* (2013.01); *B65H 2403/942* (2013.01); *B65H 2404/6111* (2013.01); *B65H 2801/27* (2013.01); *G03G 2215/00675* (2013.01); *G03G 2215/00848* (2013.01); *G03G 2215/00877* (2013.01)

(58) Field of Classification Search

CPC .... B65H 29/52; B65H 29/60; B65H 2404/63; B65H 2404/633; B65H 2404/74

See application file for complete search history.

(56) References Cited

U.S. PATENT DOCUMENTS

| | | | | |
|---|---|---|---|---|
| 6,375,180 | B1 | 4/2002 | Kawano et al. | |
| 8,807,564 | B2 * | 8/2014 | Reidhaar | B65H 85/00 271/186 |
| 2008/0182740 | A1 * | 7/2008 | Fukasawa | B65H 45/18 493/405 |
| 2008/0211158 | A1 * | 9/2008 | Fukasawa | B65H 37/04 270/1.01 |
| 2008/0290593 | A1 * | 11/2008 | Lee | B65H 5/36 271/265.01 |
| 2009/0214278 | A1 * | 8/2009 | Kawachi | B65H 29/52 399/397 |
| 2010/0327521 | A1 * | 12/2010 | Hiramatsu | B65H 5/38 271/264 |
| 2011/0285076 | A1 * | 11/2011 | Fujiwara | B65H 29/52 271/186 |
| 2013/0001869 | A1 * | 1/2013 | Ujiie | B65H 85/00 271/225 |

FOREIGN PATENT DOCUMENTS

JP A-2000-327205 11/2000

* cited by examiner

*Primary Examiner* — Patrick Cicchino
(74) *Attorney, Agent, or Firm* — Oliff PLC

(57) ABSTRACT

Provided is a post-processing device including a transport unit that transports a recording material which is sequentially transported from an upstream side toward a post-processing unit that performs post-processing on the recording material, a standby unit that is connected to the transport unit, and allows a recording material which is backhauled by a transport section reversible from the transport unit to temporarily standby, a transport member that transport the recording material which stands by in the standby unit and the recording material which is transported in the transport unit to the post-processing unit with the recording materials stacked, and an elastic member that is arranged on an upstream side of a connection position of the transport unit where the standby unit is connected, guides the recording material sequentially transported from the upstream side to the post-processing unit, and guides the backhauled recording material to the standby unit.

3 Claims, 8 Drawing Sheets

POST-PROCESSING DEVICE

CROSS-REFERENCE TO RELATED APPLICATIONS

This application is based on and claims priority under 35 USC 119 from Japanese Patent Application No. 2014-059391 filed Mar. 24, 2014.

BACKGROUND

Technical Field

The present invention relates to a post-processing device.

SUMMARY

According to an aspect of the invention, there is provided a post-processing device including:

a transport unit that transports a recording material which is sequentially transported from an upstream side toward a post-processing unit that performs post-processing on the recording material;

a standby unit that is connected to the transport unit, and allows a recording material which is backhauled by a transport section reversible from the transport unit to temporarily stand by;

a transport member that transport the recording material which stands by in the standby unit and the recording material which is transported in the transport unit to the post-processing unit with the recording materials stacked; and an elastic member that is arranged on an upstream side of a connection position of the transport unit where the standby unit is connected, guides the recording material sequentially transported from the upstream side to the post-processing unit, and guides the backhauled recording material to the standby unit.

BRIEF DESCRIPTION OF THE DRAWINGS

Exemplary embodiments of the present invention will be described in detail based on the following figures, wherein.

DETAILED DESCRIPTION

Figure 1:
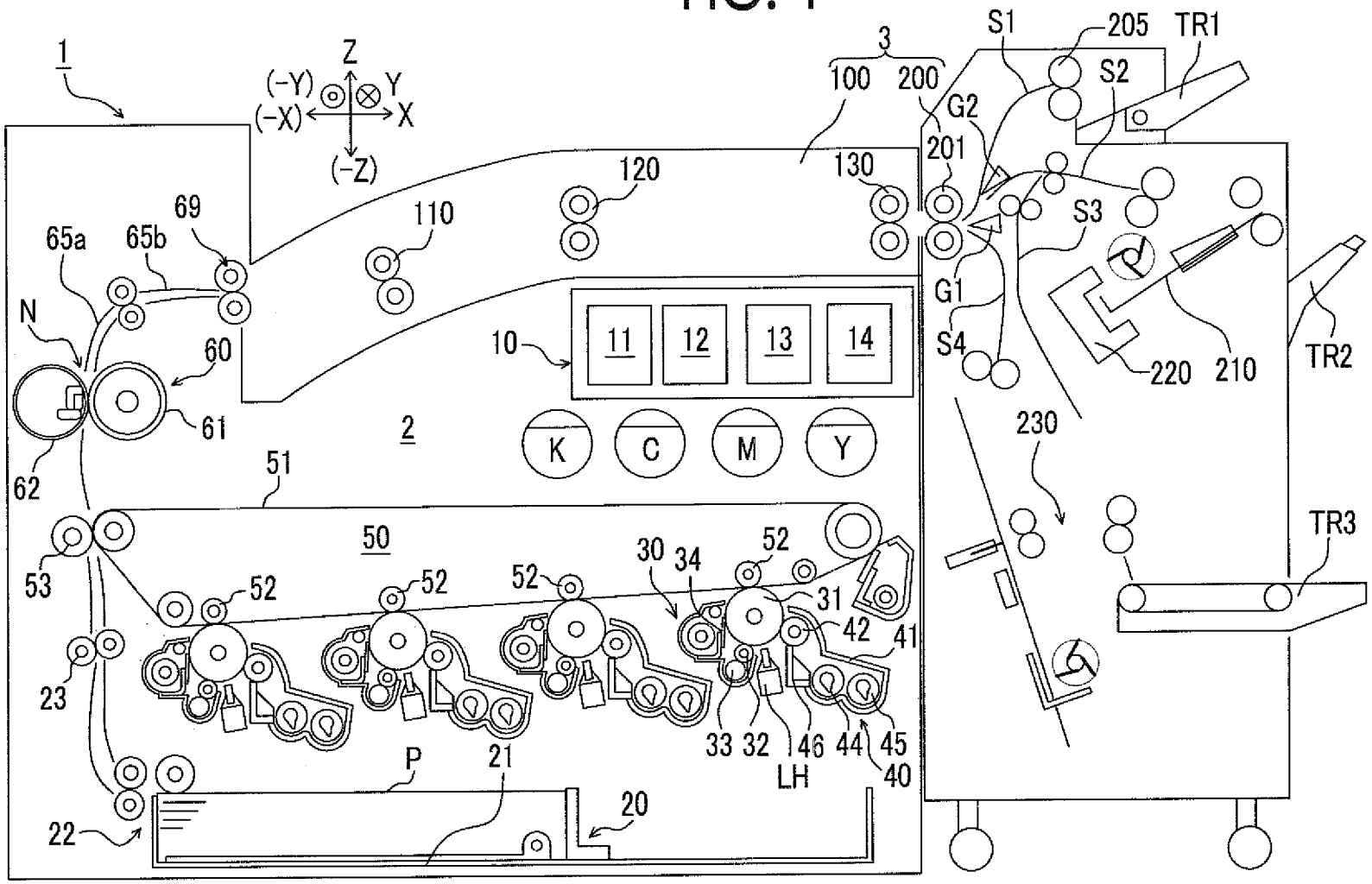
FIG. 1 is a schematic cross-sectional view illustrating an internal configuration of an image forming system.

Hereinafter, the invention will be described in detail with reference to the accompanying drawings and by using exemplary embodiments and specific examples. However, the invention is not limited to the exemplary embodiments and the specific examples.

In addition, the drawings that are used in the following description are schematic, and it should be noted that the ratio of each dimension and the like are different from actual and members that are not necessary for the description are appropriately omitted for ease of understanding.

In the drawings, the front-back direction is referred to as an X-axis direction, the right-to-left direction is referred to as a Y-axis direction, and the up-and-down direction is referred to as a Z-axis direction to facilitate the understanding of the following description.

(1) Overall Configuration and Operation of Image Forming System

FIG. 1 is a schematic configuration view illustrating an image forming system 1 to which a post-processing device according to this exemplary embodiment is applied. The image forming system 1 that is illustrated in FIG. 1 includes an image forming apparatus 2 such as a printer and a copying machine that forms an image by an electrophotography method, and a sheet processing apparatus 3 that performs post-processing on sheets P where toner images are formed by the image forming apparatus 2. Hereinafter, an overall configuration and an operation of the image forming system 1 will be described with reference to the drawing.

(1.1) Overall Configuration and Operation of Image Forming Apparatus

The image forming apparatus 2 is configured to have a control device 10, a sheet feeding device 20, photoconductor units 30, developing devices 40, a transfer device 50, and a fixing device 60. A transport device 100 is arranged on an upper surface (Z direction) of the image forming apparatus 2, and the sheet P as a recording material where the image is recorded is guided to a post-processing device 200.

The control device 10 has an image forming apparatus control unit 11 that controls the operation of the image forming apparatus 2, a controller unit 12 that prepares image data in response to a print processing request, an exposure control unit 13 that controls lighting of an exposure device LH, a power supply device 14, and the like. The power supply device 14 applies voltage to charging rollers 32, developing rollers 42, primary image transfer rollers 52, a secondary image transfer roller 53 (described later), and the like, and supplies power to the exposure device LH.

The controller unit 12 converts printing information that is input from an external information transmission device (for example, a personal computer) to image information for forming a latent image, and outputs a driving signal to the exposure device LH at a predetermined timing. The exposure device LH according to this exemplary embodiment is configured to have an LED head where light emitting diodes (LEDs) are linearly arranged.

The sheet feeding device 20 is disposed in a bottom portion of the image forming apparatus 2. The sheet feeding device 20 has a sheet loading plate 21, and the multiple sheets P as recording media are loaded on an upper surface of the sheet loading plate 21. The sheets P that are loaded on the sheet loading plate 21 with width-direction positions determined by a regulating plate (not illustrated) are drawn out forward (−X direction), sheet by sheet, from an upper side by a sheet drawer unit 22, and then are transported to a nip portion of a registration roller pair 23.

The photoconductor units 30 are disposed in parallel above the sheet feeding device 20 (Z direction), and have photosensitive drums 31 as rotationally driven image holding members. The charging rollers 32, the exposure device LE, the developing devices 40, the primary image transfer rollers 52, and cleaning blades 34 are arranged in a direction of rotation of the photosensitive drums 31. Cleaning rollers 33 that clean surfaces of the charging rollers 32 are arranged to face and to be in contact with the charging rollers 32.

The developing devices 40 have developing housings 41 in which developers are accommodated. The developing rollers 42 that are arranged to face the photosensitive drums 31, and a pair of augers 44 and 45 that stir and transport the developer to the developing roller 42 side and arranged diagonally downward from a back surface side of the developing roller 42 are arranged in the developing housings 41. Layer regulating members 46 that regulate the layer thicknesses of the developers are arranged in proximity to the developing rollers 42.

Each of the developing devices 40 is configured to be substantially similarly to the other developing devices 40 with the exception of the developers accommodated in the developing housings 41. The developing devices 40 respectively form yellow (Y), magenta (M), cyan (C), and black (K) toner images.

Surfaces of the rotating photosensitive drums 31 are charged by the charging rollers 32, and electrostatic latent images are formed by latent image forming light that is emitted from the exposure device LH. The electrostatic latent images that are formed on the photosensitive drums 31 are developed as the toner images by the developing rollers 42.

The transfer device 50 has an intermediate image transfer belt 51 where the toner images of the respective colors that are formed in the photosensitive drums 31 of the respective photoconductor units 30 are subjected to multi layer transfer, and the primary image transfer rollers 52 that perform sequential transfer (primary image transfer) on the toner images of the respective colors formed in the respective photoconductor units 30 to the intermediate image transfer belt 51. The transfer device 50 is configured to further have the secondary image transfer roller 53 that performs collective transfer (secondary image transfer) on the toner images of the respective colors, which are superposed on the intermediate image transfer belt 51 and transferred, to the sheet P as the recording medium.

The toner images of the respective colors, which are formed on the photosensitive drums 31 of the respective photoconductor units 30, are subjected to sequential electrostatic transfer (primary image transfer) on the intermediate image transfer belt 51 by the primary image transfer rollers 52 to which a predetermined transfer voltage is applied from the power supply device 14, which is controlled by the image forming apparatus control unit 11, and the like so that superposed toner images in which toner of the respective colors are superposed are formed.

The superposed toner images on the intermediate image transfer belt 51 are transported to an area (secondary image transfer unit T) where the secondary image transfer roller 53 is arranged as a result of a movement of the intermediate image transfer belt 51. At the timing when the superposed toner images are transported to the secondary image transfer unit T, the sheet P is supplied from the sheet feeding device 20 to the secondary image transfer unit T. A predetermined transfer voltage is applied to the secondary image transfer roller 53 from the power supply device 14 that is controlled by the image forming apparatus control unit 11, and a multi-toner image on the intermediate image transfer belt 51 is collectively transferred on the sheet P that is sent out from the registration roller pair 23 and is guided by a transportation guide.

The residual toner on the surfaces of the photosensitive drums 31 is removed by the cleaning blades 34, and is collected in a waste developer accommodating portion. The surfaces of the photosensitive drums 31 are charged again by the charging rollers 32. The residue that is not removed by the cleaning blades 34 but is attached to the charging rollers 32 is captured and accumulated on surfaces of the cleaning rollers 33 that rotate in contact with the charging rollers 32.

The fixing device 60 has a heating module 61 and a pressure module 62, and a fixing nip portion N (fixing area) is formed by an urge area between the heating module 61 and the pressure module 62.

The sheet P, to which the toner image is transferred in the transfer device 50, is transported to the fixing device 60 through the transportation guide in a state where the toner image is not fixed. The toner image is fixed on the sheet P that is transported to the fixing device 60 due to pressure bonding and heating effects by the pair of heating module 61 and pressure module 62.

The sheet P where the fixed toner image is formed is guided by transportation guides 65*a* and 65*b*, and is discharged from a discharge roller pair 69 to the transport device 100 that is arranged on the upper surface of the image forming apparatus 2.

(1.2) Configuration and Operation of Sheet Processing Apparatus

The sheet processing apparatus 3 has the transport device 100 that transports the sheets P which are output from the image forming apparatus 2 to a further downstream side, and the post-processing device 200 that has a compile tray 210 which aligns the sheets P transported from the transport device 100 into a bundle, an end binding mechanism (stapler) 220 which binds end portions of the sheets P, a saddle folding processing mechanism 230 that performs saddle folding processing to produce a booklet, and the like.

The transport device 100 has an inlet roller 110 that receives the sheets P which are output via the discharge roller pair 69 of the image forming apparatus 2, a first transport roller 120 that transports the sheets P which are received by the inlet roller 110 to the downstream side, and a second transport roller 130 that transports the sheets P toward the post-processing device 200.

The post-processing device 200 has a first post-processing transport path S1, a second post-processing transport path S2, a third post-processing transport path S3, and a fourth post-processing transport path S4 as recording material transport units on a downstream side of a receiving roller 201 that receives the sheets P via the transport device 100. The first post-processing transport path S1, the second post-processing transport path S2, and the fourth post-processing transport path S4 are selected by a switching gate G1. In addition, the first post-processing transport path S1 and the second post-processing transport path S2 are selected by a switching gate G2.

The first post-processing transport path S1 is connected to a top tray TR1, and the sheet P that is not post-processed is discharged from the first post-processing transport path S1.

The second post-processing transport path S2 is connected to the compile tray 210 that is disposed on the downstream side, and a sheet bundle PB that is produced by the stapler 220 is discharged on a stacker tray TR2.

The third post-processing transport path S3 as a recording material standby unit is disposed to branch from the middle of the second post-processing transport path S2, and temporarily holds the sheet P which is reversely transported from the compile tray 210 side.

The fourth post-processing transport path S4 is connected to the saddle folding processing mechanism 230, and the booklet that is produced by the saddle folding processing mechanism 230 is discharged to a booklet tray TR3.

Figure 2:
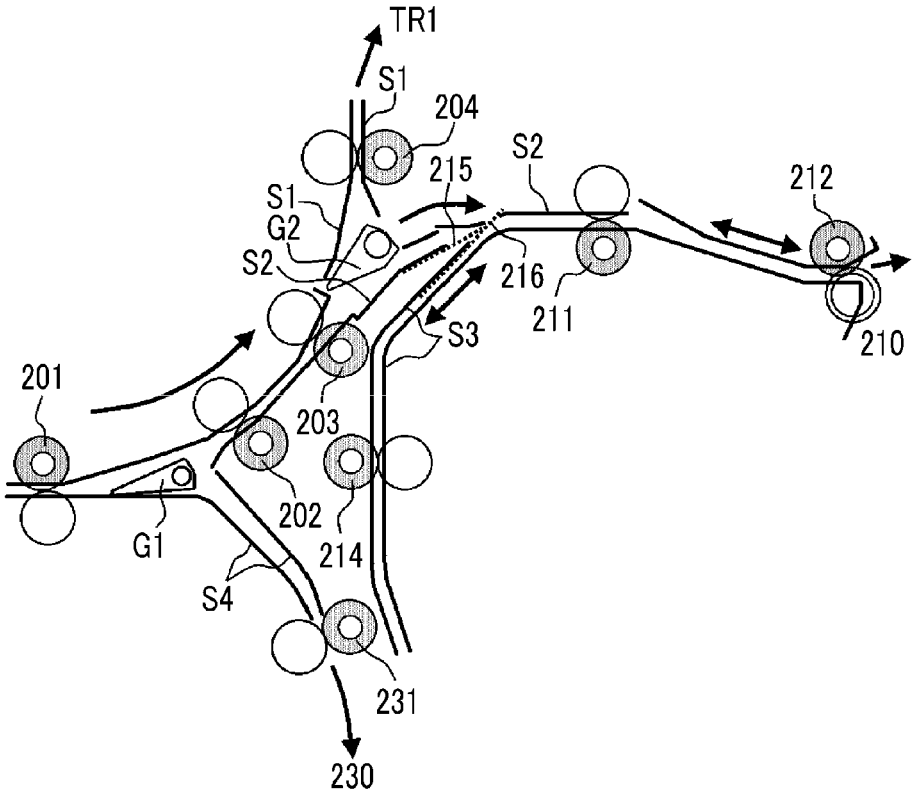
FIG. 2 is a schematic cross-sectional view illustrating a recording material transport path of a post-processing device.
Figure 3A:
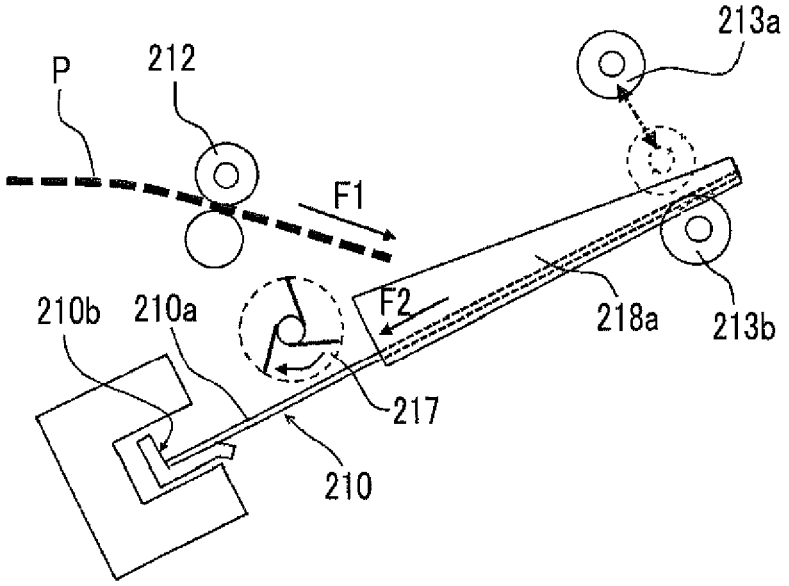
FIG. 3A is a schematic cross-sectional view illustrating a configuration of the vicinity of a compile tray.
Figure 3B:
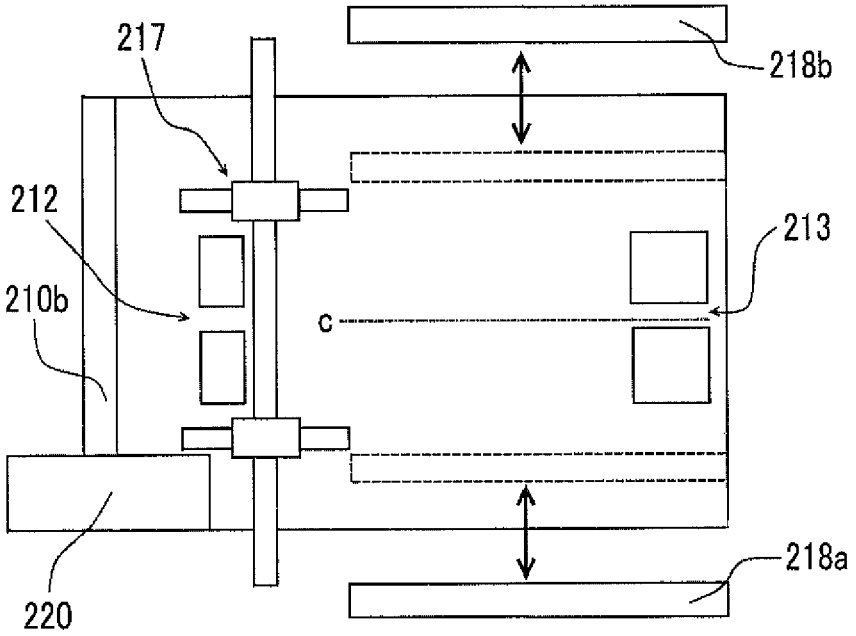
FIG. 3B is a planar schematic view illustrating the configuration of the vicinity of the compile tray.
Figure 4A:
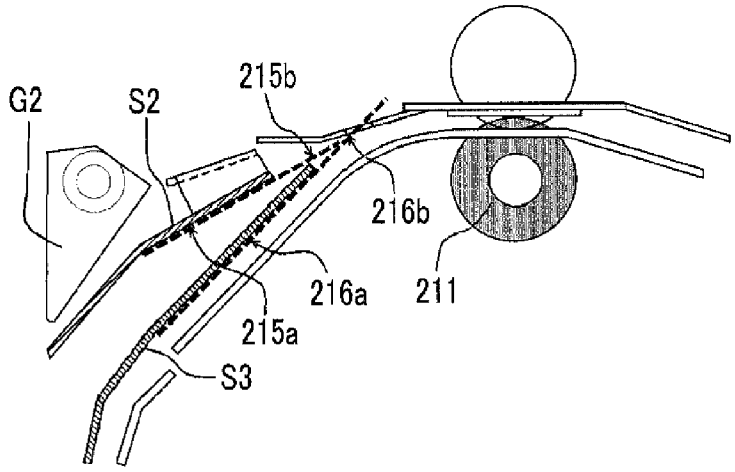
FIG. 4A is an enlarged schematic cross-sectional view illustrating the arrangement of a first elastic member and a second elastic member in a second post-processing transport path S2.
Figure 4B:
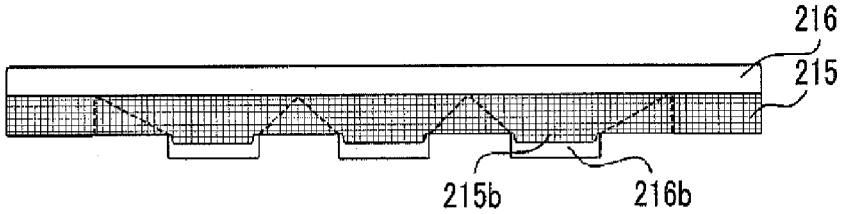
FIG. 4B is a planar schematic view illustrating specific examples of the first elastic member and the second elastic member.
Figure 5A:
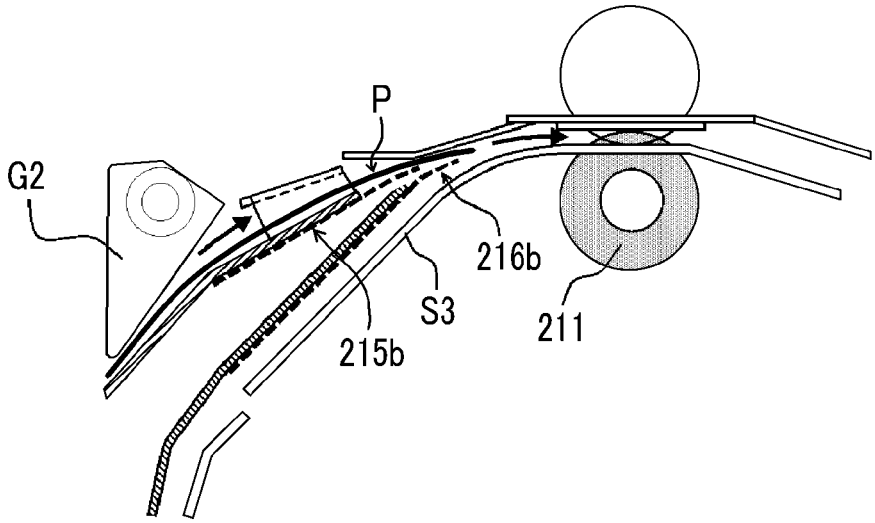
FIGS. 5A and 5B are schematic views illustrating effects of the first elastic member and the second elastic member in the second post-processing transport path S2.
Figure 5B:
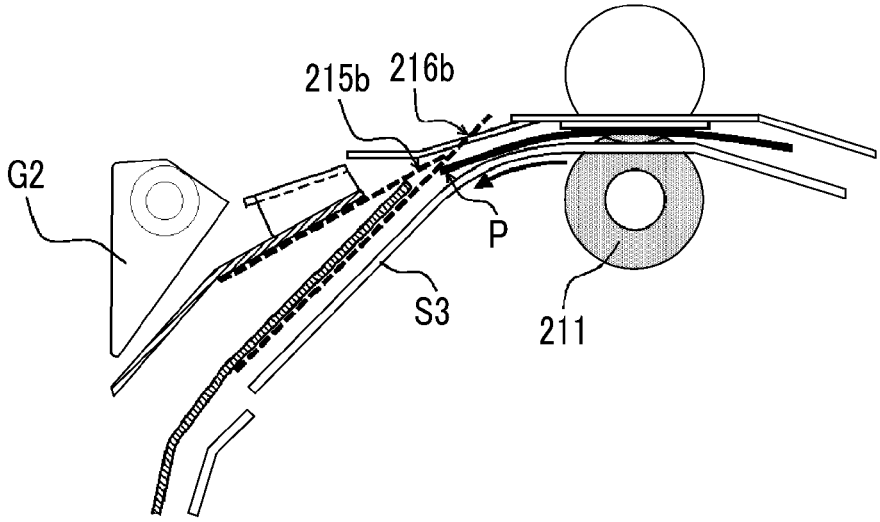

(2) Configuration and Operation in Vicinity of Recording Material Transport Path and Compile Tray FIG. 2 is a schematic cross-sectional view illustrating a recording material transport path in the post-processing device 200. FIG. 3A is a schematic cross-sectional view illustrating a configuration of the vicinity of the compile tray 210. FIG. 3B is a planar schematic view illustrating the configuration of the vicinity of the compile tray 210. FIG. 4A is an enlarged schematic cross-sectional view illustrating the arrangement of a first elastic member 215 and a second elastic member 216 in the second post-processing transport path S2. FIG. 4B is a planar schematic view illustrating specific examples of the first elastic member 215 and the second elastic member 216. FIGS. 5A and 5B are schematic views illustrating effects of the first elastic member 215 and the second elastic member 216 in the second post-processing transport path S2.

(2.1) Recording Material Transport Path

The receiving roller 201 that brings in the sheet P as the recording material through a recording material discharge port 100*a* of the transport device 100 is arranged in the post-processing device 200.

The post-processing transport paths as the transport units branch into two on the downstream side of the receiving roller 201. A transport roller 204 and a top discharge roller 205 are disposed in the first post-processing transport path S1, which branches upward in a vertical direction (Z direction in FIG. 1), among the post-processing transport path, and discharge the sheet P where the image is formed as it is or the unnecessary sheet P to the top tray TR1.

Among the post-processing transport paths, the fourth post-processing transport path S4, which has a transport roller 231 and branches downward (−Z direction in FIG. 1), binds the sheet bundle PB in a central portion and then discharges the sheet bundle PB after performing saddle folding processing to fold the sheet bundle PB into two in the bound portion.

Among the post-processing transport paths that branch upward, the second post-processing transport path S2, which branches further in a substantially horizontal direction (X direction in FIG. 1), performs end binding processing and corner portion binding processing on the sheet bundle PB along one end edge and discharges the plural sheet bundles PB in a state of being offset by set.

A reverse roller 211 for a buffer and a compile discharge roller 212 are disposed in the second post-processing transport path S2, and the sheets P are sequentially discharged on the compile tray 210 by the compile discharge roller 212.

In addition, if necessary, the sheet bundle PB that is aligned on the compile tray 210 is discharged onto the stacker tray TR2 by an eject roller 213 after the binding processing by the stapler 220.

(2.2) Configuration and Operation in Vicinity of Compile Tray

The compile tray 210 is disposed to be inclined so that the sheet P drops along an upper surface of a bottom portion 210*a* where the sheet P is loaded. As illustrated in FIGS. 4A and 4B, the compile tray 210, on one end side, has an end guide 210*b* that is arranged to align trailing edge side end portions of the sheets P which drop along the bottom portion 210*a*.

A paddle 217 is disposed above the compile tray 210. The paddle 217 is configured to push the sheet P that is transported in a first traveling direction F1 (illustrated in FIGS. 4A and 4B) in a second traveling direction F2 (illustrated in FIGS. 4A and 4B) on the compile tray 210 by rotating in an arrow direction in FIGS. 4A and 4B.

Tampers 218 that align the sheets P in a width direction are disposed in a middle portion of the compile tray 210 in a direction intersecting with the second traveling direction F2 so that a distance from each other changes in response to driving of a motor (not illustrated).

The eject roller (sheet bundle transport roller) 213 is disposed on a tip end side of the compile tray 210. The eject roller (sheet bundle transport roller) 213 is configured to have a first eject roller 213*a* and a second eject roller 213*b*.

The first eject roller 213*a* is configured to be retractable with respect to the second eject roller 213*b* in response to the driving of the motor and the like (not illustrated). The second eject roller 213*b* is arranged to be fixed to a back surface side of a surface of the bottom portion 210*a* of the compile tray 210 where the sheet P is loaded, and is configured to perform only a rotational movement.

The second eject roller 213*b* is rotationally driven in a state where the first eject roller 213*a* is in contact with the sheet P, and the sheet bundle PB is raised to be transported to the stacker tray TR2.

The third post-processing transport path S3 branches toward a lower side between the reverse roller 211 of the second post-processing transport path S2 and the switching gate G2, and a reversible buffer roller 214 is disposed in the third post-processing transport path S3.

(2.3) Switching Configuration and Effect of Recording Material Transport Path

As illustrated in FIGS. 4A and 4B, the first elastic member 215 and the second elastic member 216 that guide the sheet P which is sequentially transported from the receiving roller 201 to the compile tray 210 side and guide the sheet P which is reversely transported by the reverse roller 211 to the third post-processing transport path S3 are disposed on an upstream side of a connection position of the second post-processing transport path S2 where the third post-processing transport path S3 is connected.

The first elastic member 215 is arranged so that a base end portion 215*a* is fixedly supported by the second post-processing transport path S2 and a tip end portion 215*b* protrudes to a sheet transport area of the second post-processing transport path S2.

The second elastic member 216 is arranged so that a base end portion 216*a* is fixedly supported by the third post-processing transport path S3 and a tip end portion 216*b* protrudes to a downstream side more than the tip end portion 215*b* of the first elastic member 215

The first elastic member 215 and the second elastic member 216 are formed of Mylar films having different thicknesses from each other. When the thickness of the first elastic member 215 is t1 and the thickness of the second elastic member 216 is t2, t1 is larger than t2.

Specifically, the thickness t1 of the first elastic member 215 is 0.15 mm to 0.3 mm, and the thickness t2 of the second elastic member 216 is 0.05 mm to 0.14 mm.

The specific examples of the first elastic member 215 and the second elastic member 216 are illustrated in FIG. 43. The first elastic member 215 is shaped so that the three tip end portions 215*b* protrude in a rectangular shape in a central portion. The second elastic member 216 protrudes in a rectangular shape at three places to correspond to the tip end portions 215*h* of the first elastic member 215. In addition, triangular notches are formed on both sides of each of the tip end portions 216*b*. Accordingly, the second elastic member 216 is relatively more likely to be bent than the first elastic member 215.

As a result, the tip end portion 216*b* of the second elastic member 216 is bent downward, as illustrated in FIG. 5A, due to a transporting force in a leading edge portion of the sheet P when the sheet P is transported to a downstream side in the second post-processing transport path S2, and a gap is formed between the tip end portion 215*b* of the first elastic member 215 and the tip end portion 216*b* of the second elastic member 216. As such, the second post-processing transport path S2 communicates with the downstream side, and the sheet P is transported to the downstream side.

In addition, as illustrated in FIG. 5B, a surface side of the second elastic member 216 is supported by the first elastic member 215 that is thick and is relatively higher in rigidity than the second elastic member 216 when the sheet P, which is temporarily transported to the compile tray 210 side, is transported to an upstream side through reversal between the reverse roller 211 and the compile discharge roller 212. Then, the second post-processing transport path S2 is closed, and a leading edge (trailing edge in the case of progressive transport) of the backhauled sheet P is guided in contact with a back surface side of the second elastic member 216 and is transported to the third post-processing transport path S3.

(3) Stacking Operation During Post-Processing

FIGS. 6A to 6D are schematic views illustrating a stacking operation in the post-processing device 200. F g. 7 is an example of a timing chart of the stacking operation in the post-processing device 200. FIGS. 8A to 8D are schematic views illustrating a three-sheet stacking operation in the post-processing device 200.

Hereinafter, the stacking operation in the post-processing device 200 will be described with reference to the drawings.

(3.1) Stacking Operation During Post-Processing

In a case where the binding processing as an example of post-processing is performed in the post-processing device 200 on the sheets P that are sequentially transported via the transport device 100, the switching gate G1 is switched to the second post-processing transport path S2 side, and the sheets P that are transported from the receiving roller 201 are sequentially transported to the compile tray 210 via the second post-processing transport path 82. Then, the binding processing is performed by the stapler 220 in a state where a predetermined number of the sheets P are aligned as the sheet bundle PB.

In this case, a predetermined processing time is required in the post-processing device 200 for the stapler 220 to perform the binding processing on the sheet bundle PB which is aligned on the compile tray 210 and for the sheet bundle PB to be discharged to the stacker tray TR2. However, from the high-speed image forming apparatus 2, next sets of sheets P are transported successively to the post-processing device 200 via the transport device 100.

Accordingly, in the post-processing device 200, the sheets P are detected by a receiving detection sensor SR1 that is disposed at a nip outlet of the receiving roller 201 when the first sheet P of the next set is transported to the receiving roller 201.

Figure 6A:
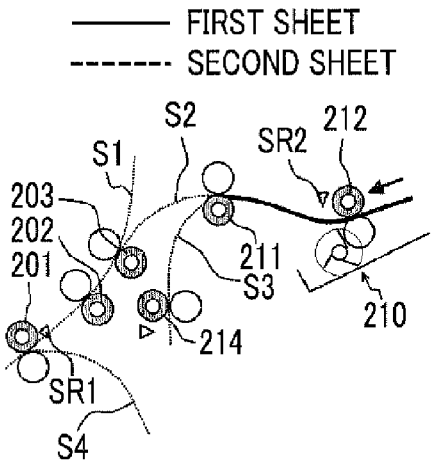
FIGS. 6A to 6D are schematic views illustrating a stacking operation in the post-processing device.

The first sheet P of the next set is temporarily transported to the second post-processing transport path S2 with the switching gate G1 switched (refer to FIG. 6A). The reverse roller 211 and the compile discharge roller 212 that are disposed in the second post-processing transport path S2 are stopped and then reversed when the trailing edge of the sheet P is detected by the receiving detection sensor SR1 and the trailing edge of the sheet P passes the connection position of the third post-processing transport path S3 with respect to the second post-processing transport path S2.

Figure 6B:
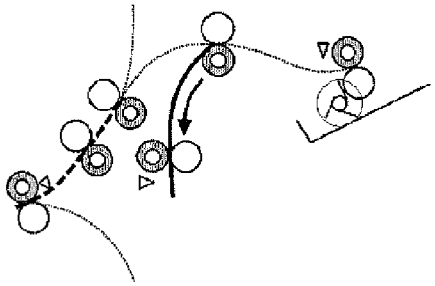
Figure 6C:
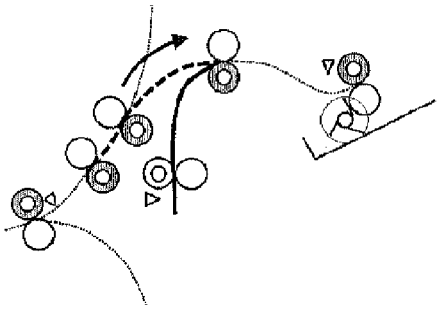
Figure 6D:
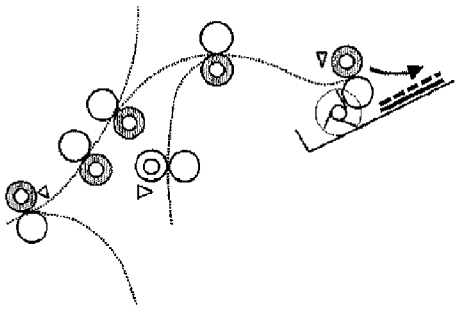

As a result, the sheet P that is temporarily transported to the second post-processing transport path S2 is backhauled by the reverse roller 211 and the compile discharge roller 212 which are reversed, and the trailing edge of the sheet P is guided in contact with the back surface side of the second elastic member 216 and is transported to the third post-processing transport path S3 (refer to FIG. 6B).

Then, the sheet P is transported by the buffer roller 214 that is disposed in the third post-processing transport path S3, and comes out of a nip of the reverse roller 211 that is disposed in the second post-processing transport path 32. Then, the buffer roller 214 stops, and the first sheet P is temporarily held in the third post-processing transport path S3.

Next, the second sheet P of the next set is transported to the second post-processing transport path S2. In synchronization with the transport of the leading edge of the second sheet P of the next set to immediately in front of the reverse roller 211 that is disposed in the second post-processing transport path S2, the first sheet P that is temporarily held in the third post-processing transport path S3 is transported to the reverse roller 211 in a state of being stacked with the leading edge of the second sheet P of the next set with the buffer roller 214 disposed in the third post-processing transport path S3 reversed (refer to FIG. 60).

Then, the first sheet P and the second sheet P of the next set are transported to the compile tray 210, by the compile discharge roller 212, in a stacked state (refer to FIG. 6P).

The second elastic member 216 is disposed in the post-processing device 200 according to this exemplary embodiment to guide the sheet P, which is reversed by the reverse roller 211 and transported, to the third post-processing transport path S3. The surface side of the second elastic member 216 is supported by the first elastic member 215, which is thick and is relatively higher in rigidity than the second elastic member 216, to close the second post-processing transport path S2, and the trailing edge of the backhauled sheet P is guided in contact with the back surface side of the second elastic member 216 and is transported to the third post-processing transport path S3.

Accordingly, no transport path switching operation is required when the first sheet P of the next set is backhauled by the reverse roller 211 and the compile discharge roller 212 and is transported into the third post-processing transport path S3, and the backhauling may be initiated immediately.

When the second sheet P of the next set is transported to the second post-processing transport path S2, the tip end portion 216*b* of the second elastic member 216 is bent downward due to the transporting force of the leading edge portion of the second sheet P, the gap is formed between the tip end portion 215*b* of the first elastic member 215 and the tip end portion 216*b* of the second elastic member 216, and the second sheet P is transported to the downstream side. In other words, no transport path switching operation is required for the stacking as well, and the stacking with the first sheet P which is transported out of the third post-processing transport path S3 is allowed.

According to the post-processing device 200 of this exemplary embodiment, no transport path switching operation is required and the backhauling may be initiated immediately in this manner. As such, the post-processing device 200 according to this exemplary embodiment may be combined with the high-speed image forming apparatus 2. Also, since no transport path switching operation is required, noise following a switching operation may be suppressed, an increase in cost may be suppressed, and reduction in size may be allowed.

(3.2) Timing Chart of Stacking Operation

Figure 7:
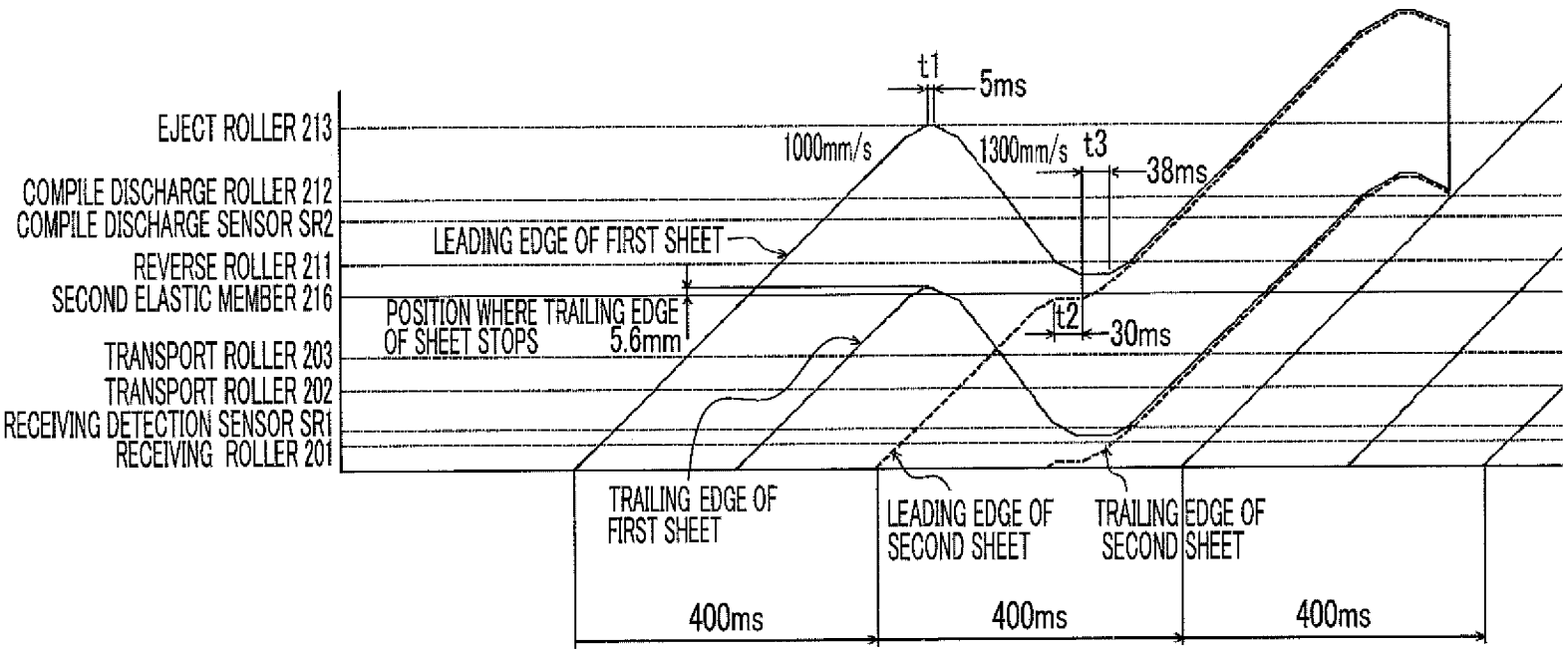
FIG. 7 is an example of a timing chart of the stacking operation in the post-processing device.

FIG. 7 illustrates an example of the timing chart of the operation at a time of stacking between the first sheet P and the second sheet P of the next set in a case where post-processing is performed in the compile tray 210.

In this example, the stacking operation is performed under the following conditions.

Sheet P: Letter size (landscape-feeding)

Interval of sheet receiving from the transport device 100: 400 ms

Transport speed in the second post-processing transport path S2: 1,000 mm/s

Transport speed during the backhauling: 1,300 mm/s

In FIG. 7, t1 represents a wait time at a time of switching of the reverse roller 211 and the compile discharge roller 212 from a normal rotation to reversal. According to this example, no transport path switching operation is required, and thus t1 is equal to 5 ms and the switching may be performed substantially immediately.

(3.3) Three-Sheet Stacking Operation

Figure 8A:
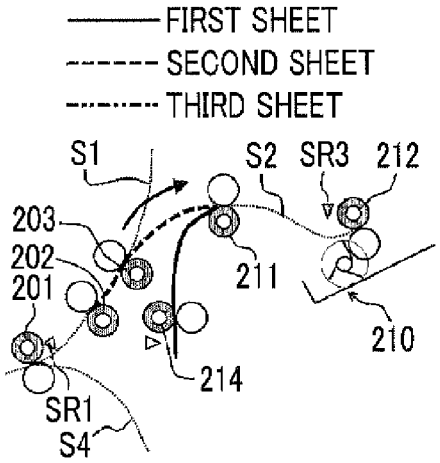
FIGS. 8A to 8D are schematic views illustrating a three-sheet stacking operation in the post-processing device.
Figure 8B:
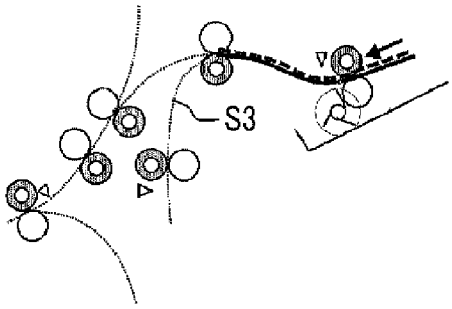
Figure 8C:
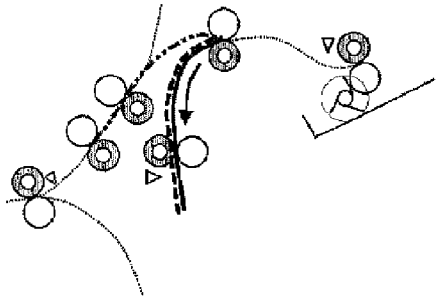

As illustrated in FIG. 8A, the first sheet P that is temporarily held in the third post-processing transport path S3 is transported to the reverse roller 211 in a state of being stacked with the leading edge of the second sheet P of the next set with the buffer roller 214 disposed in the third post-processing transport path S3 reversed in synchronization with the transport of the leading edge of the second sheet P of the next set to immediately in front of the reverse roller 211 that is disposed in the second post-processing transport path S2 during the transport of the second sheet P of the next set to the second post-processing transport path S2.

Then, the trailing edge of the sheet P is transported, in a state where the first sheet P and the second sheet P of the next set are stacked, beyond the connection position of the third post-processing transport path S3 in the second post-processing transport path S2. Then, the reverse roller 211 and the compile discharge roller 212 are reversed, and the trailing edge of the sheet P is guided in contact with the back surface side of the second elastic member 216 and is transported to the third post-processing transport path S3 in a state where the first sheet P and the second sheet P are stacked (refer to FIG. 8B).

Then, the third sheet P of the next set is transported to the second post-processing transport path S2. In synchronization with the transport of the leading edge of the third sheet P of the next set to immediately in front of the reverse roller 211 that is disposed in the second post-processing transport path S2, the first sheet P and the second sheet P of the next set that are temporarily held in the third post-processing transport path S3 are transported to the reverse roller 211 in a state of being stacked with the buffer roller 214 disposed in the third post-processing transport path S3 reversed (refer to FIG. 8C).

Figure 8D:
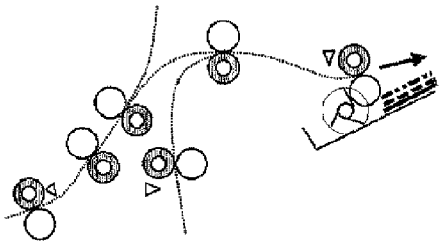

The first sheet P, the second sheet P, and the third sheet P of the next set are transported to the compile tray 210 by the compile discharge roller 212 in a state where the three sheets are stacked (refer to FIG. 8D).

Combination with the higher-speed image forming apparatus 2 is allowed by holding the two sheets P of the next set in the third post-processing transport path S3 in a stacked state and stacking the two sheets P with the third sheet P of the next set in this manner. Also, since no transport path switching operation is required, noise following a switching operation may be suppressed, an increase in cost may be suppressed, and reduction in size may be allowed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a transport unit that transports a recording material which is sequentially transported from an upstream side toward a post-processing unit that performs post-processing on the recording material;

a standby unit that is connected to the transport unit, and allows a recording material which is backhauled by a transport section reversible from the transport unit to temporarily stand by;

a transport member that transport the recording material which stands by in the standby unit and the recording material which is transported in the transport unit to the post-processing unit with the recording materials stacked; and an elastic member that is arranged on an upstream side of a connection position of the transport unit where the standby unit is connected, guides the recording material sequentially transported from the upstream side to the post-processing unit, and guides the backhauled recording material to the standby unit, wherein the elastic member includes a first elastic member with a base end portion that is fixedly supported by the transport unit and a tip end portion that protrudes to a recording material transport area of the transport unit, and a second elastic member with a base end portion that is fixedly supported by the standby unit and a tip end portion that protrudes to a downstream side more than the tip end portion of the first elastic member.

2. The post-processing device according to claim 1, wherein the first elastic member and the second elastic member are formed of Mylar films having different thicknesses from each other, and t1 is larger than t2 when a first thickness of the first elastic member is t1 and a second thickness of the second elastic member is t2.

3. The post-processing device according to claim 1, wherein the first thickness t1 of the first elastic member is 0.15 mm to 0.3 mm and the second thickness t2 of the second elastic member is 0.05 mm to 0.14 mm.

* * * * *